United States Patent [19]

Grieger et al.

[11] 3,999,464

[45] Dec. 28, 1976

[54] FLUID ACTUATOR DEVICE FOR A HIGH-VOLTAGE POWER CIRCUIT BREAKER

[75] Inventors: Gerhard Grieger; Joaquin Bohrdt, both of Berlin, Germany

[73] Assignee: Siemens Aktiengesellschaft, Munich, Germany

[22] Filed: Feb. 13, 1975

[21] Appl. No.: 549,783

[30] Foreign Application Priority Data

Mar. 18, 1974 Germany ..... 2413409

[52] U.S. Cl. ..... 91/417 R; 91/396; 91/461; 251/68

[51] Int. Cl.[2] ..... F15B 15/17; F15B 13/043; F15B 15/22

[58] Field of Search ..... 91/417 R; 251/66, 68

[56] References Cited

UNITED STATES PATENTS

| | | | |
|---|---|---|---|
| 2,379,180 | 6/1945 | Pohl | 91/417 R |
| 2,432,305 | 12/1947 | Geiger | 91/417 R |
| 2,499,253 | 2/1950 | Newell | 251/66 |
| 2,503,362 | 4/1950 | Sweet | 91/417 R |
| 2,508,843 | 5/1950 | Semak | 251/66 |
| 3,863,547 | 2/1975 | Meier | 91/417 R |

*Primary Examiner*—Paul E. Maslousky
*Attorney, Agent, or Firm*—Kenyon & Kenyon Reilly Carr & Chapin

[57] ABSTRACT

A fluid actuating device for an electric switching apparatus such as a high-voltage power circuit breaker or the like includes an actuator for actuating the electric switching apparatus. The actuator includes a cylinder and an actuator differential piston movable in the cylinder between first and second positions corresponding to the open and closed positions of the switching apparatus. The actuator differential piston has two end-faces for receiving fluid pressure force and one of the end-faces has a larger surface area than the other one of the end-faces. A pressure fluid supply supplies fluid under pressure and is connected to the actuator for continuously supplying fluid under pressure to the other one of the end-faces. A switching-valve alternately interrupts and connects the fluid from the pressure fluid supply to the one end-face of the actuator differential piston whereby the actuator differential piston is caused to move between its first and second positions. A control valve includes a valve member movable between first and second end-positions for respectively interrupting and connecting the fluid from the pressure fluid supply to the switching-valve for actuating the same. A spring is arranged to spring-load the valve member at the first end-position. The valve member can be moved from the first end-position to the second end-position against the force of the spring by suitable mechanical or fluid means. A latching mechanism is connected to the control valve for latching the valve member in the second end-position whereby the actuator differential piston is held in the second position against the fluid pressue force applied to the other one of the end-faces thereof.

6 Claims, 1 Drawing Figure

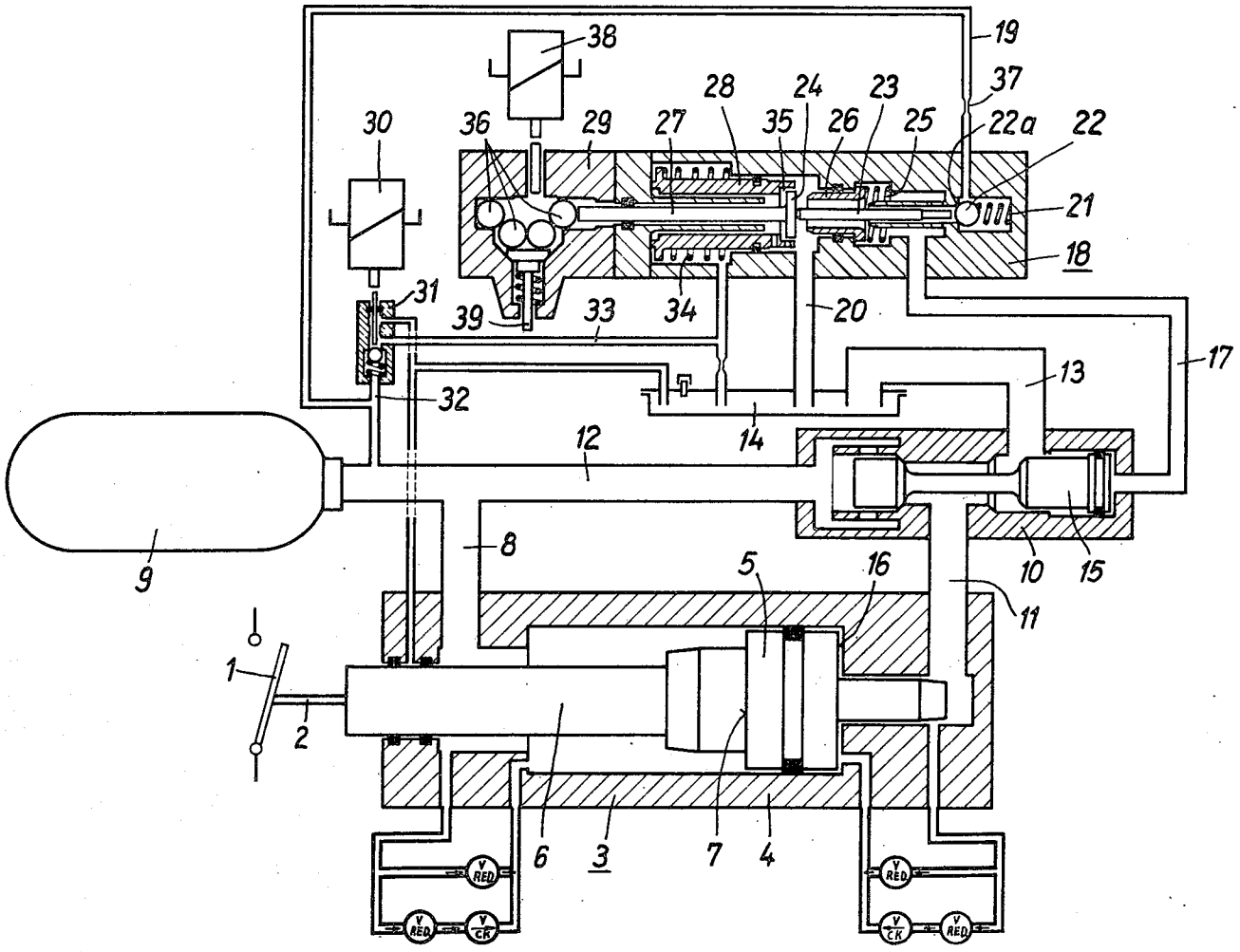
17
22
21
18
19
37
22a
25
23
26
24
35
28
27
29
38
36
30
31
32
39
33
34
20
13
14
12
8
15
10
11
16
5
7
4
3
6
2
1
9
Y RED
Y GR

FLUID ACTUATOR DEVICE FOR A HIGH-VOLTAGE POWER CIRCUIT BREAKER

BACKGROUND OF THE INVENTION

The invention relates to a fluid actuator device for a high-voltage power circuit breaker with an actuator cylinder having a differential piston and to which pressure medium is applied continuously on the piston end-face of the small area and, selectably applied to the piston end-face of the large area. The fluid actuating device further includes a switching valve to direct pressure medium to the actuator cylinder as well as a mechanical latching device determining the switched-on position of the differential piston.

A device of the type described above is known from Swiss Patent No. 485,313 wherein the smaller piston surface is in free continuous communication with a hydraulic accumulator serving as an energy source without a valve disposed therebetween so that pressure medium is continuously admitted to the piston end-face of the small area. The piston end-face of the large area is selectably acted upon by pressure or relieved of pressure through a switching valve. In this way, a single valve is sufficient. The known breaker actuator is thus maintained in readiness to open by the continuously effective hydraulic accumulator against whose force a mechanical latch acts on the force of the accumulator acting on the switching rod of the electric circuit breaker. The mechanical latch engages the switching rod and holds the actuator piston in the closed position of the breaker.

SUMMARY OF THE INVENTION

It is an object of the invention to provide a fluid actuating device for an electric circuit breaker which affords tip-safe operation.

The present invention also makes use of a mechanical latching device and, according to a feature thereof, the mechanical latching device is connected with a three-way valve which operates the switching valve hydraulically. The movable valve member of the three-way valve has a first position which is maintained by the force of a spring and a second, latched position.

The fluid actuating device of the invention affords an advantageous tipping safety for switching on and off which can be achieved in a particularly simple manner. Tipping safety is understood here to mean a mode of operation wherein an unequivocal switching command leads to a reliable switching operation which is carried out to the end, while interference signals are suppressed by the fluid actuator device and therefore do not lead to the opening or closing of the electrical contacts of the high-voltage power circuit breaker.

The fluid actuating device according to the invention is suitable for an electric switching apparatus such as a high-voltage power circuit breaker or the like and includes an actuator for actuating the electric switching apparatus. The actuator includes a cylinder and an actuator differential piston movable in the cylinder between first and second positions corresponding to the open and closed positions of the switching apparatus. The actuator differential piston has two end-faces for receiving fluid pressure force, one of the end-faces having a larger surface area than the other one of the end-faces. Pressure fluid supply means supplies fluid under pressure and is connected to the actuator for continuously supplying fluid under pressure to the other one of the end-faces. Switching-valve means is provided for alternately interrupting and connecting the fluid from the pressure fluid supply means to the one end-face of the actuator differential piston whereby the actuator differential piston is caused to move between the first and second positions. A control valve includes valve means movable between first and second end-positions for respectively interrupting and connecting the fluid from the pressure fluid supply means to the switching-valve means for actuating the same. Resilient means is arranged to hold the valve means at the first end-position and means are provided for moving the valve means from the first end-position to the second end-position against the force of the resilient means. Latching means are connected to the control valve for latching the valve means in the second end-position whereby the actuator differential piston is held in the second position against the fluid pressure force applied to the other one of the end-faces thereof.

The control valve can be a three-way valve and the resilient means can be a spring acting on the valve means for resiliently holding the same in the first end-position.

The three-way valve includes a latching rod for acting upon the valve means. The latching rod is movable to a latching position whereat the latching rod and the latching means coact to hold the valve means in the second end-position. The means for moving the valve means can be actuating means which includes a spring-loaded actuator piston actuable for moving the latching rod to the latching position, and control means for selectively supplying fluid under pressure to the actuator piston for actuating the same.

Alternatively, the latching rod can be transferred into its latched position by mechanical means rather than by fluid action. The movement of the latching rod by mechanical means can be achieved by providing latching means in the form of a roller latch including a set of rollers for acting on the latching rod, and the means for moving the valve means can then be an actuating member arranged at the latching means for acting on the rollers for moving the latching rod to the latching position.

The latching rod can have a valve disc mounted thereon. The three-way valve can include additional valve means for connecting the switching-valve means to a low-pressure fluid location. The additional valve means can include a slideably guided valve body defining a valve seat for coacting with the valve disc for closing the valve seat when the latching rod is moved to the latched position, and a spring arranged to spring-load the valve body in a direction toward the valve disc.

The first-mentioned valve means can include: a spherical valve member spring-loaded by the first-mentioned spring; stationary valve seat means for receiving the spherical valve member in contact therewith for interrupting the fluid from the fluid pressure supply means to the switching-valve means; and, an actuator rod actuated by the latching rod for holding the spherical valve member in the open position when the latching rod is in the latched position.

The first-mentioned spring and the actuator rod can be aligned so as to cause the first-mentioned spring to act on the latching rod for returning the same to its initial positions when the latching means is released. The spring loading the sphere then constitutes here the return spring for the latching rod.

Although the invention is illustrated and described herein as a fluid actuator device for a high-voltage power circuit breaker, it is nevertheless not intended to be limited to the details shown, since various modifications may be made therin within the scope and the range of the claims. The invention, however, together with additional objects and advantages will be best understood from the following description and in connection with the accompanying drawing.

BRIEF DESCRIPTION OF THE DRAWING

The drawing is a schematic diagram illustrating the actuating device according to the invention arranged for opening and closing the contacts of an electric power circuit breaker.

DESCRIPTION OF THE PREFERRED EMBODIMENTS OF THE INVENTION

The contact 1 of an electric high-voltage power circuit breaker is actuated by an electrically insulating rod 2, which is mechanically connected with a hydraulic actuator device 3. The hydraulic actuator device 3 includes an operating cylinder 4 and an actuator piston 5 which is slideably arranged in the cylinder 4 and is constructed as a differential piston. The actuator piston is connected by means of its piston rod 6 with the actuator rod 2. The piston end-face 7 with the small area is in continuous, valveless, free communication through a line 8, with a hydraulic accumulator 9 wherein a pressure medium at a predetermined operating pressure is located.

The actuator device 3 is operated by a switching valve 10 having an outgoing control line 11 to the actuator device 3 which can be connected selectably with the line 12 carrying pressure medium, or with a relief line 13, which leads to a low-pressure tank 14. In the position shown of the movable valve member 15 of the switching valve 10, the line 11 is connected with the low-pressure tank 14, that is, the piston end-face 16 of the large area is relieved of pressure.

The movable valve member 15 of the switching valve 10 is hydraulically controlled through a line 17. The line 17 leads to a three-way valve 18. The three-way valve is continuously connected with the hydraulic accumulator 9 through a line 19 and, through a further line 20, with the low-pressure tank 14. The movable valve assembly of the three-way valve 18 includes a sphere 22 loaded by a spring 21, a plunger rod 23 as well as a valve disc 24 which cooperates with a movably guided valve body 26 which defines a valve seat. Valve body 26 is loaded by a spring 25. In the position shown, the sphere 22 is pushed against the stationary valve seat **22*a* by the force of its spring 21**.

The valve disc 24 is fastened at the free end of the latching rod 27, which can on the one hand be transferred by an actuator piston 28 into the on position, and can be transferred from this on position into the off position by a mechanical latch 29, which is constructed in the manner of a roller latch. For switching on, an electric signal is fed to the electromagnetic actuator device 30, which operates a pilot valve 31 and through the valve 31, pressure medium is fed from the accumulator 9 to the actuator piston 28 through the line 32 and the line 33. The actuator piston 28 is thereby moved to the right against the force of its spring 34. By means of a shoulder 35, the piston 28 takes along the valve disc 24. In this process, the valve disc 24 arrives at the spring-loaded, axially movable valve body 26 which blocks the connection between the lines 17 and 20. At the same time, also the actuator rod 23 is pushed against the sphere 22 in the sense of opening, so that pressure medium can flow from the line 19 into the line 17. The condition for this mode of operation is a stroke of the latching rod 27 so large that the rollers 36 of the latching device 29 can assume their latching position with certainty. A choke point 37 in the line 19 ensures that the pressure in the line 17 is built up with delay, that is, becomes fully effective only when the latched position is reached.

The pressure present in the line 17 pushes the movable valve member 15, which acts as a differential piston, into its other end position whereby the connection of the lines 11 and 13 is blocked and the connection of the lines 11 and 12 is established. Thereby, pressure medium gets from the line 12 to the large-area piston end-face 16 of the piston 5 so that the breaker closes. In this position the breaker is mechanically latched by hydraulic means after it has reached its closed position. Only after an off command is given at the electromagnetic actuator device 38 is the roller latch 29 unlatched so that the three-way valve 18 again assumes the position shown in the drawing.

Instead of the hydraulic switching described, the breaker can also be switched on mechanically. For this purpose the roller latch 29 has the actuating member 39 which acts on the rollers 36 in the direction of establishing the latched position.

As is apparent, the spring 21 which loads the sphere 22 of the three-way valve 18 is at the same time the return spring of the latching rod 27 so that the expenditure of mechanical means can be kept low.

What is claimed is:

1. A fluid actuating device for an electric switching apparatus such as a high-voltage power circuit breaker or the like comprising: an actuator for actuating the electric switching apparatus, said actuator including a cylinder and an actuator differential piston movable in said cylinder between first and second positions corresponding to the open and closed positions of the switching apparatus, said actuator differential piston having two end-faces for receiving fluid pressure force, one of said end-faces having a larger surface area than the other one of said end-faces; pressure fluid supply means for supplying fluid under pressure, said pressure fluid supply means being connected to said actuator for continuously supplying fluid under pressure to said other one of said end-faces; switching-valve means for alternately interrupting and connecting the fluid from said pressure fluid supply means to said one end-face of said actuator differential piston whereby said actuator differential piston is caused to move between said first and second positions; a control valve including valve means movable between first and second end-positions for respectively interrupting and connecting the fluid from said pressure fluid supply means to said switching-valve means for actuating the same, and resilient means arranged to hold said valve means at said first end-position; means for moving said valve means from said first end-position to said second end-position against the force of said resilient means; and, latching means connected to said control valve for latching said valve means in said second end-position whereby said actuator differential piston is held in said second position against the fluid pressure force applied to said other one of said end-faces of said actuator differential piston; said control valve being a three-way valve and said resilient means being a spring acting on said valve means for resiliently holding the same in said first end-position, said three-way valve including a latching rod for acting upon said valve means, said latching rod being movable to a latching position whereat said latching rod and said latching means coact to hold said valve means in said second end-position; and, said means for moving said valve means being actuating means comprising: a spring-loaded actuator piston actuable for moving said latching rod to said latching position, and control means for selectively supplying fluid under pressure to said actuator piston for actuating the same.

2. The fluid actuating device of claim 1, said latching rod having a valve disc mounted thereon, said three-way valve comprising additional valve means for connecting said switching-valve means to a low-pressure fluid location, said additional valve means including a slideably guided valve body defining a valve seat for coacting with said valve disc for closing said valve seat when said latching rod is moved to said latched position, and a spring arranged to spring-load said valve body in a direction toward said valve disc.

3. The fluid actuating device of claim 2, said valve disc being rigidly connected to said latching rod.

4. The fluid actuating device of claim 1, said first-mentioned valve means comprising: a spherical valve member spring-loaded by said first-mentioned spring; stationary valve seat means for receiving said spherical valve member in contact therewith for interrupting the fluid from said fluid pressure supply means to said switching-valve means; and, an actuator rod actuated by said latching rod for holding said spherical valve member in the open position when said latching rod is in said latched position.

5. The fluid actuating device of claim 4, said first-mentioned spring and said actuator rod being aligned so as to cause the first-mentioned spring to act on said latching rod for returning the same to its initial positions when said latching means is released.

6. A fluid actuating device for an electric switching apparatus such as a high-voltage power circuit breaker or the like comprising: an actuator for actuating the electric switching apparatus, said actuator including a cylinder and an actuator differentialpiston movable in said cylinder between first and second positions corresponding to the open and closed positions of the switching apparatus, said actuator differential piston having two end faces for receiving fluid pressure force, one of said end-faces having a larger surface area than the other one of said end-faces; pressure fluid supply means for supplying fluid under pressure, said pressure fluid supply means being connected to said actuator for continuously supplying fluid under pressure to said other one of said end-faces; switching-valve means for alternately interrupting and connecting the fluid from said pressure fluid supply means to said one end-face of said actuator differential piston whereby said actuator differential piston is caused to move between said first and second positions; a three-way control valve including valve means movable between first and second end positions for respectively interrupting and connecting the fluid from said pressure fluid supply means to said switching valve means for actuating the same, a spring acting on said valve means for resiliently holding the same in said first end position, and a latching rod for acting upon said valve means, said latching rod being movable to a latching position whereat said latching rod and a latching means coact to hold said valve means in said second end position; latching means connected to said control valve for latching said valve means in said second end position, said latching means being a roller latch including a set of rollers for acting on said latching rod; and actuator means for mechanically engaging said valve means and for moving the same from said first end position to said second end position against the force of said spring, said actuator means being an actuating member for acting on said rollers of said latching means for moving said latching rod to said latching position whereat said latching rod and said latching means coact to hold said valve means in said second end position; whereby said actuator differential piston is held in said second position against the fluid pressure force applied to said other one of said endfaces of said actuator differential piston.

* * * * *